US011774883B2

(12) United States Patent
Furukawa et al.

(10) Patent No.: US 11,774,883 B2
(45) Date of Patent: Oct. 3, 2023

(54) IMAGE FORMING APPARATUS THAT EXECUTES A MODE FOR DRIVING EACH OF CONVEYANCE MEMBER AND DEVELOPER CARRYING MEMBER WITHOUT EXECUTING IMAGE FORMING OPERATION

(71) Applicant: CANON KABUSHIKI KAISHA, Tokyo (JP)

(72) Inventors: Mitsuhiro Furukawa, Tokyo (JP); Masahiro Ootsuka, Tokyo (JP); Shunichi Takada, Saitama (JP); Tatsuya Inoue, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/591,273

(22) Filed: Feb. 2, 2022

(65) Prior Publication Data

US 2022/0260940 A1 Aug. 18, 2022

(30) Foreign Application Priority Data

Feb. 18, 2021 (JP) ..... 2021-024133

(51) Int. Cl.
*G03G 15/09* (2006.01)
*G03G 21/20* (2006.01)
(Continued)

(52) U.S. Cl.
CPC ..... *G03G 15/0891* (2013.01); *G03G 15/09* (2013.01); *G03G 15/5004* (2013.01);
(Continued)

(58) Field of Classification Search
CPC ..... G03G 15/0891; G03G 15/09; G03G 15/5004; G03G 2215/00084;
(Continued)

(56) References Cited

U.S. PATENT DOCUMENTS 3,572,555 A * 3/1971 Knight ..... B01F 31/85 118/308
2013/0230333 A1* 9/2013 Hirobe ..... G03G 15/0848 399/254
2018/0270381 A1* 9/2018 Ikuta ..... H04N 1/00896

FOREIGN PATENT DOCUMENTS

JP H1078741 A 3/1998
JP 2010224347 A 10/2010
(Continued)

*Primary Examiner* — Arlene Heredia
*Assistant Examiner* — Laura Roth
(74) *Attorney, Agent, or Firm* — Canon U.S.A., Inc. I.P. Division

(57) ABSTRACT

An image forming apparatus to execute an image forming operation for forming an image includes an image bearing member, a development unit, a drive unit, a controller, and a humidity detection unit to detect humidity near the development unit. The development unit contains developer and includes a conveyance member to convey the developer and a developer carrying member to carry the developer to a position where an electrostatic latent image formed on the image bearing member is developed. The controller controls the conveyance and the developer carrying member through the drive unit not to execute a mode for driving the conveyance and the developer carrying member without executing the image forming operation when the humidity detected when power of the image forming apparatus is shifted from off to on is higher than a predetermined value, and to execute the mode when the detected humidity falls below the predetermined value afterward.

6 Claims, 12 Drawing Sheets

(51) Int. Cl.
*G03G 15/08* (2006.01)
*G03G 15/00* (2006.01)

(52) U.S. Cl.
CPC ..... *G03G 21/20* (2013.01); *G03G 21/206* (2013.01); *G03G 2215/00084* (2013.01)

(58) Field of Classification Search
CPC .. G03G 15/0887; G03G 21/20; G03G 21/206; G03G 2221/1645; G03G 2215/00071; G03G 15/5033
See application file for complete search history.

(56) References Cited

FOREIGN PATENT DOCUMENTS

| | | | |
|---|---|---|---|
| JP | 2013182093 | A | 9/2013 |
| JP | 2020008648 | A | 1/2020 |

* cited by examiner

IMAGE FORMING APPARATUS THAT EXECUTES A MODE FOR DRIVING EACH OF CONVEYANCE MEMBER AND DEVELOPER CARRYING MEMBER WITHOUT EXECUTING IMAGE FORMING OPERATION

BACKGROUND

Field

The present disclosure relates to an image forming apparatus including a development device that develops an electrostatic latent image formed on an image bearing member.

Description of the Related Art

An image forming apparatus discussed in Japanese Patent Application Laid-Open No. 2020-8648 drives a conveying screw and a developing sleeve of a development device at a speed lower than a normal speed in an idle rotation mode in a case where a predetermined time or longer has elapsed since a previous stoppage of driving of the conveying screw and the developing sleeve, at power-on. The idle rotation mode is a mode for driving the conveying screw and the developing sleeve without performing image formation. After driving the conveying screw and the developing sleeve at the speed lower than the normal speed in the idle rotation mode and charging toner, the image forming apparatus executes an image forming mode for driving the conveying screw and the developing sleeve at the normal speed.

However, in a case where relative humidity near the development device at power-on is higher than a predetermined value, a decline in the charge amount of the toner can be noticeable compared with a case where the relative humidity is lower than or equal to the predetermined value.

In a case where a decline in the charge amount of the toner is noticeable, even if the conveying screw and the developing sleeve are driven at the speed lower than the normal speed in the idle rotation mode as discussed in Japanese Patent Application Laid-Open No. 2020-8648, the toner can scatter accompanying driving of the developing sleeve in the idle rotation mode.

Meanwhile, in the case where the relative humidity near the development device at power-on is higher than the predetermined value, the temperature inside the image forming apparatus is increased by temperature adjustment or the like of a fixing device after power-on, so that the relative humidity near the development device decreases and eventually falls below the predetermined value.

SUMMARY

The present disclosure is directed to providing an apparatus that can reduce toner scattering that accompanies driving of a developing sleeve in an idle rotation mode.

According to an aspect of the present disclosure, an image forming apparatus to execute an image forming operation for forming an image includes an image bearing member, a development unit including a development container configured to contain a developer including toner and carrier, a conveyance member configured to convey the developer contained in the development container, and a developer carrying member configured to carry the developer to convey the developer to a position at which an electrostatic latent image formed on the image bearing member is developed, a humidity detection unit configured to detect humidity near the development unit, a drive unit configured to drive each of the conveyance member and the developer carrying member, and a controller configured to control the drive unit not to execute a mode for driving each of the conveyance member and the developer carrying member without executing the image forming operation in a case where the humidity detected by the humidity detection unit when power of the image forming apparatus is shifted from off to on is higher than a predetermined value, and to execute the mode in a case where the humidity detected by the humidity detection unit falls below the predetermined value afterward.

Further features of the present disclosure will become apparent from the following description of exemplary embodiments with reference to the attached drawings.

DESCRIPTION OF THE EMBODIMENTS

Exemplary embodiments of the present disclosure will be described in detail below with reference to the attached drawings. The following exemplary embodiments are not intended to limit the present disclosure set forth in the claims, and not all combinations of features described in exemplary embodiments are essential to a solution of the present disclosure. The present disclosure can be implemented in various uses such as printers, various printing presses, copiers, facsimiles, and multi-functional apparatuses.

(Configuration of Image Forming Apparatus)

Figure 1:
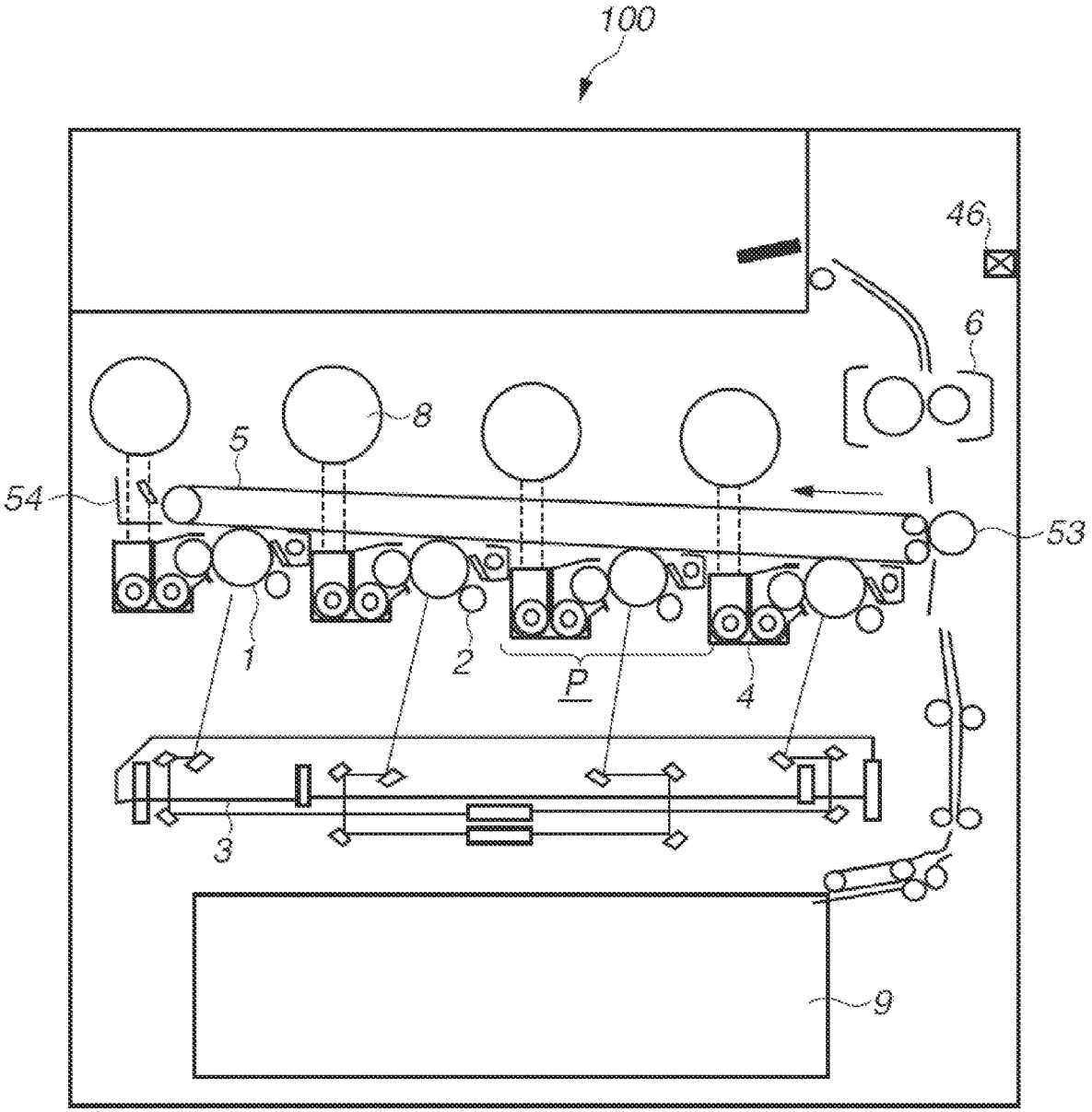
FIG. 1 is a cross-sectional diagram illustrating a configuration of an image forming apparatus according to a first exemplary embodiment.
Figure 2:
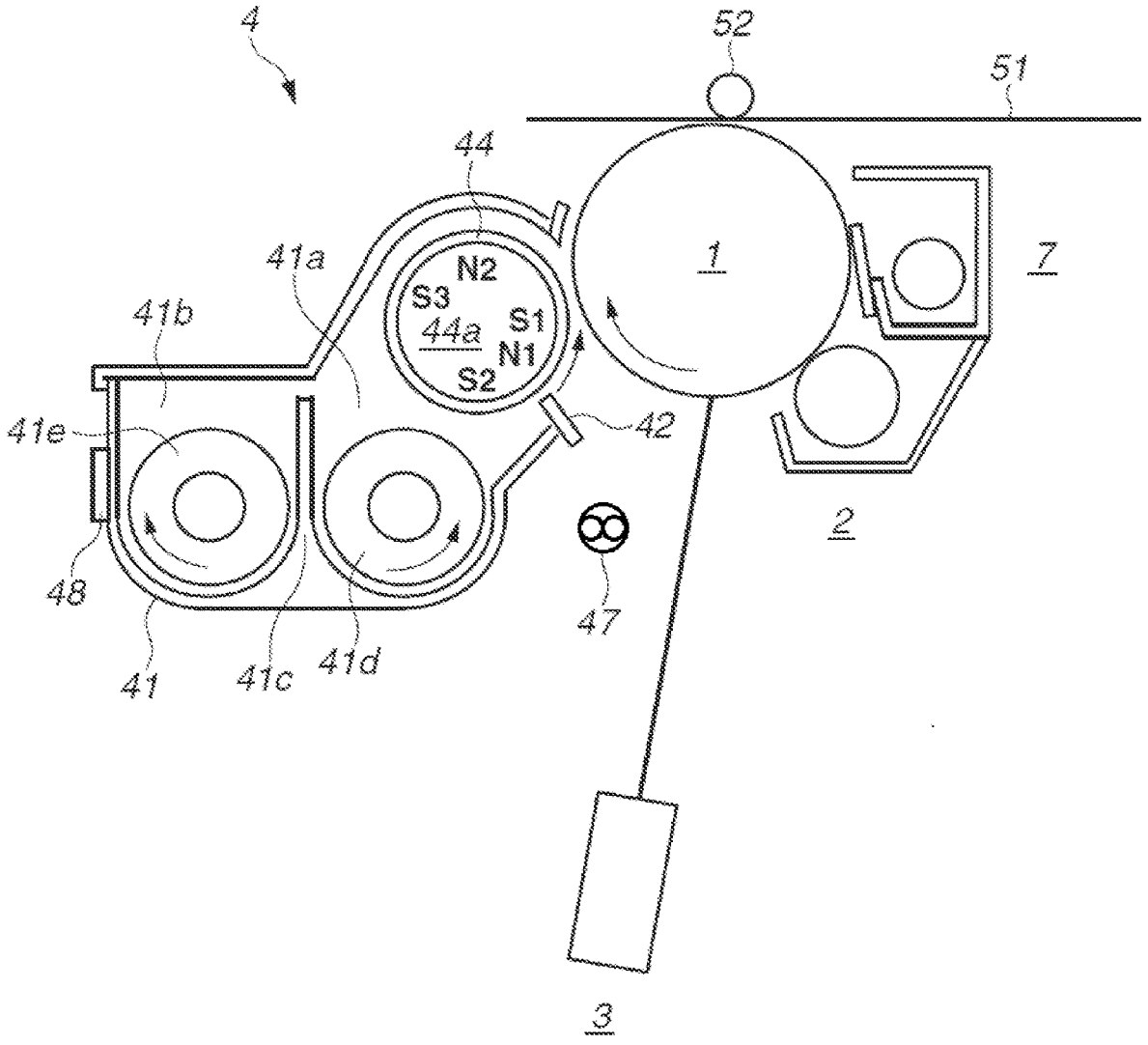
FIG. 2 is a schematic diagram illustrating a configuration of the image forming apparatus according to the first exemplary embodiment.

First, an overall configuration and operation of an image forming apparatus according to a first exemplary embodiment will be described. FIG. 1 is a cross-sectional diagram schematically illustrating an entire electrophotographic image forming apparatus. FIG. 2 is a schematic diagram illustrating a configuration of an image forming unit.

An image forming apparatus 100 forms an image on a recording medium based on image information from a document reading device connected to a main body of the image forming apparatus 100 or a host apparatus such as a personal computer (PC) communicatively connected to the main body of the image forming apparatus 100. For example, the image forming apparatus 100 forms a full-color image of four colors of yellow (Y), magenta (M), cyan (C), and black (K) on a recording medium such as a recording sheet, a plastic sheet, or a cloth using an electrophotographic image forming means.

The image forming apparatus 100 is an image forming apparatus of four-drum tandem type and includes first, second, third, and fourth image forming units PY, PM, PC, and PK that form yellow, magenta, cyan, and black images, respectively, as a plurality of image forming units. While an intermediate transfer belt 51, which is an intermediate transfer member included in a transfer device 5, moves in an arrow direction in FIG. 1 and passes the image forming units PY to PK, the images of the respective colors are superimposed on the intermediate transfer belt 51 in the image forming units PY to PK. A multiple-toner image formed of the superimposed images on the intermediate transfer belt 51 is transferred to a recording medium, so that a recorded image is obtained. In the first exemplary embodiment, the process speed is set to 400 mm/s.

In the following exemplary embodiments, the configurations of the respective image forming units PY, PM, PC, and PK are substantially identical except that the respective development colors are different. In the following description, in a case where it is not necessary to distinguish the image forming units, indexes Y, M, C, and K given to a reference numeral to represent an element belonging to any of the image forming units PY to PK will be omitted, and the elements will be collectively described as represented by the image forming unit P.

The image forming unit P includes a photosensitive drum 1 consisting of a drum-shaped photosensitive member as an electrostatic latent image bearing member (image bearing member) that bears an electrostatic latent image based on image information. Around the photosensitive drum 1, a charging roller 2 serving as a charging device, an exposure device 3 serving as a laser exposure optical system, a development device 4, the transfer device 5, and a cleaning device 7 are disposed.

A toner cartridge 8 contains replenishment toner to be supplied to the development device 4. The transfer device 5 has the intermediate transfer belt 51 serving as the intermediate transfer member. The intermediate transfer belt 51 is held by a plurality of rollers and rotates in the arrow direction in FIG. 1. Further, a primary transfer roller 52 is disposed at a position facing the photosensitive drum 1 via the intermediate transfer belt 51. Furthermore, a secondary transfer roller 53 is disposed at a position facing one of the rollers holding the intermediate transfer belt 51.

In image formation, first, the charging roller 2 uniformly charges a surface of the rotating photosensitive drum 1. Next, the exposure device 3 subjects the charged surface of the photosensitive drum 1 to scanning exposure based on an image information signal, thereby forming an electrostatic latent image on the photosensitive drum 1. The development device 4 visualizes the electrostatic latent image formed on the photosensitive drum 1 as a toner image, using toner of developer.

The toner image formed on the photosensitive drum 1 is primarily transferred to the intermediate transfer belt 51 by an action of a primary transfer bias voltage applied to the primary transfer roller 52 at a primary transfer nip portion where the intermediate transfer belt 51 and the photosensitive drum 1 are in contact with each other. For example, in forming a full color image of four colors, a toner image is transferred from each photosensitive drum 1 sequentially to the intermediate transfer belt 51 starting from the image forming unit PY, and a multiple-toner image formed of the superimposed toner images of four colors is formed on the intermediate transfer belt 51.

Meanwhile, in synchronization with the toner image on the intermediate transfer belt 51, a recording medium contained in a sheet cassette 9 is conveyed by a pickup roller, a conveyance roller, a registration roller, and the like, to a secondary transfer nip portion where the intermediate transfer belt 51 and the secondary transfer roller 53 are in contact with each other. Subsequently, the multiple-toner image on the intermediate transfer belt 51 is transferred to the recording medium by an action of a secondary transfer bias voltage applied to the secondary transfer roller 53 at the secondary transfer nip portion.

Then, the recording medium separated from the intermediate transfer belt 51 is conveyed to a fixing device 6. The fixing device 6 heats and presses the multiple-toner image transferred to the recording medium, so that toners are melted and mixed, and the multiple-toner image is fixed to the recording medium. Then, the recording medium to which the multiple-toner image is fixed is ejected to the outside of the image forming apparatus 100.

The cleaning device 7 collects toner and the like remaining on the photosensitive drum 1 after the primary transfer process. This makes the photosensitive drum 1 ready for the next image formation process. An intermediate transfer member cleaner 54 removes toner and the like remaining on the intermediate transfer belt 51 after the secondary transfer process.

The image forming apparatus 100 can also form a single color or multicolor image using the image forming unit of a desired single color such as black, or the image forming units of several desired colors among the four colors.

(Configuration of Development Device)

Figure 3:
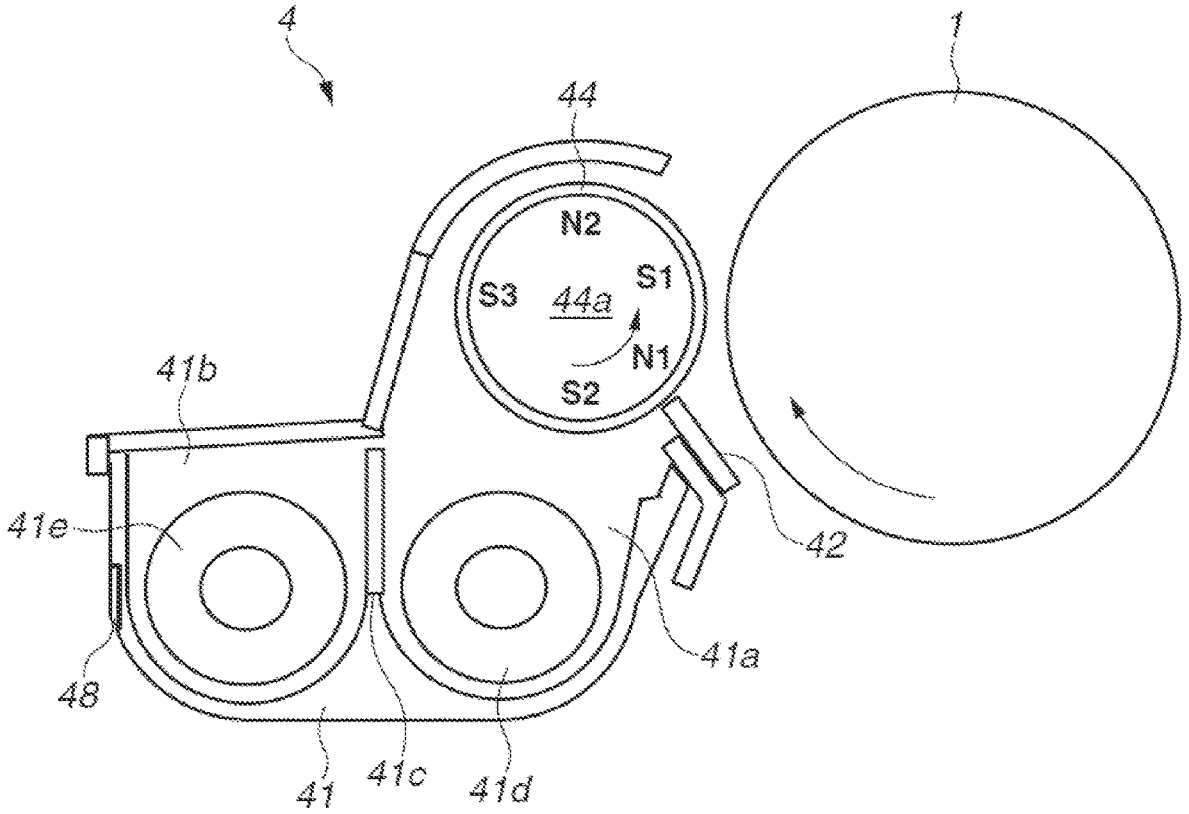
FIG. 3 is a cross-sectional diagram illustrating a configuration of a development device according to the first exemplary embodiment.
Figure 4:
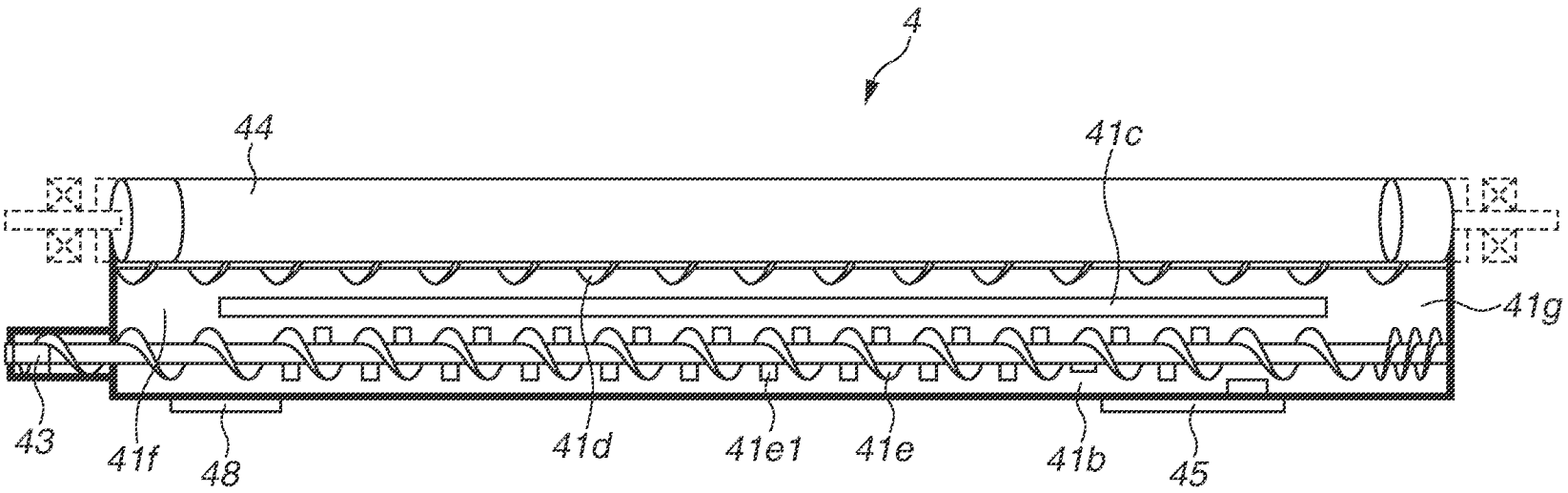
FIG. 4 is a schematic diagram illustrating a configuration of the development device according to the first exemplary embodiment.

Next, a configuration of the development device 4 will be further described with reference to FIG. 3 and FIG. 4. FIG. 3 is a cross-sectional diagram illustrating the configuration of the development device 4. FIG. 4 is a schematic diagram illustrating the configuration of the development device 4.

The development device 4 includes a development container 41 that contains a two-component developer (hereinafter simply referred to as the developer) including nonmagnetic toner and magnetic carrier. The development container 41 includes a developing sleeve 44 serving as a rotatable developer carrying member, and a magnet roll 44*a* consisting of a magnet fixed inside the developing sleeve 44 to serve as a magnetic field generating means.

The development device 4 includes a developing blade 42 serving as a developer regulating member that regulates an amount of the developer carried and conveyed by the developing sleeve 44. The developing blade 42 is disposed facing the developing sleeve 44 and forms a thin layer of the developer on a surface of the developing sleeve 44. Screw members 41*d* and 41*e* each serving as a conveyance member that stirs and conveys the developer inside the development container 41 are disposed in the development container 41. Each of the screw members 41*d* and 41*e* and the developing sleeve 44 is rotated by a driving means.

The inside of the development container 41 is partitioned into a development chamber 41*a* and a stirring chamber 41*b* by a partition 41*c* extending in the vertical direction. The screw member 41*d* is disposed in the development chamber 41*a*, and the screw member 41*e* is disposed in the stirring chamber 41*b*. At both ends (on the left side and the right side in FIG. 4) of the partition 41*c* in the longitudinal direction, delivery portions 41*f* and 41*g* that enable the developer to move between the development chamber 41*a* and the stirring chamber 41*b* are disposed.

In the first exemplary embodiment, the screw members 41*d* and 41*e* are each formed by disposing a spiral blade as a conveyance portion around a shaft (rotation shaft) of a magnetic member. The screw member 41*e* is provided with, in addition to the spiral blade, a stirring rib 41*e*1 protruding from the rotation shaft in the radial direction and having a predetermined width in a conveyance direction of the developer. The stirring rib 41*e*1 stirs the developer as the rotation shaft rotates.

The screw member 41*d* stirs and conveys the developer inside the development chamber 41*a*. The screw member 41*e* makes the toner density uniform based on automatic toner replenishment (ATR) control. In other words, the replenishment toner supplied from a replenishment device to be described below with reference to FIG. 5 and the developer consisting of the toner and the magnetic carrier inside the stirring chamber 41*b* are stirred and conveyed, so that the toner density is made uniform.

The screw members 41*d* and 41*e* are disposed in substantially parallel with the rotational axis direction of the developing sleeve 44. The screw member 41*d* and the screw member 41*e* convey the developer in directions opposite to each other in the rotational axis direction of the developing sleeve 44. In this way, the developer is circulated inside the development container 41 via the delivery portions 41*f* and 41*g* by the screw members 41*d* and 41*e*. In other words, the developer inside the development chamber 41*a*, in which the toner density is decreased as a result of consumption of toner in the development process, is moved by a conveying force of the screw members 41*d* and 41*e* to the inside of the stirring chamber 41*b* via the delivery portion 41*f* (on the left side in FIG. 4).

Figure 5:
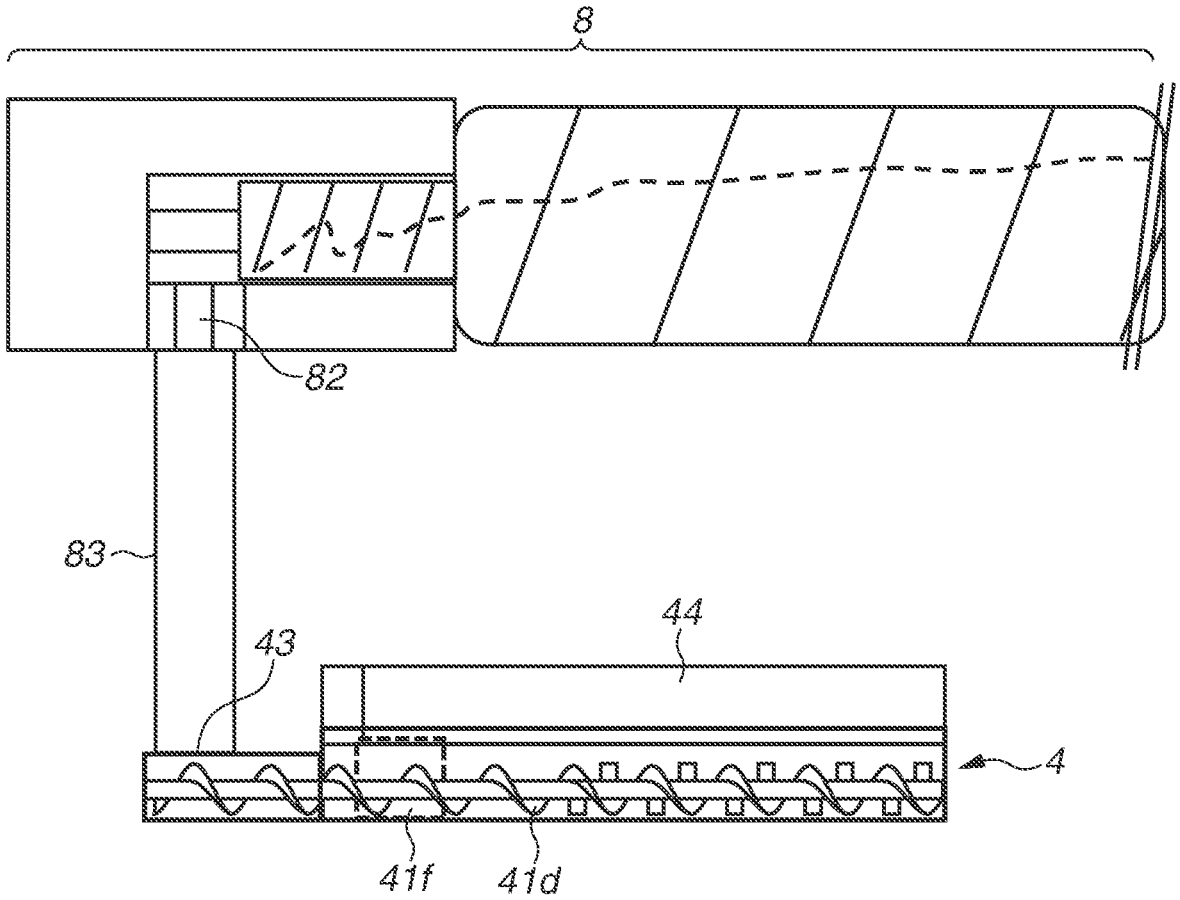
FIG. 5 is a cross-sectional diagram illustrating a configuration of a replenishment device according to the first exemplary embodiment.

As illustrated in FIG. 4, a toner replenishment port 43 for supplying the replenishment toner is disposed at a most upstream portion of the stirring chamber 41*b*. FIG. 5 is a cross-sectional diagram illustrating the configuration of the replenishment device for supplying the replenishment toner to the development device 4. As illustrated in FIG. 5, the toner replenishment port 43 connects to a replenishment developer container (the toner cartridge 8) serving as a replenishment container that contains the replenishment toner.

The operation of the toner cartridge 8 is controlled based on an image ratio in image formation, a result of detection by an inductance sensor 45 serving as a toner density sensor, and a result of patch image density detection by a patch image density detection sensor, by the ATR control, so that the toner is supplied to the most upstream portion of the stirring chamber 41*b*.

Subsequently, the developer inside the stirring chamber 41*b* in which the toner is supplied and stirred moves from the stirring chamber 41*b* to the development chamber 41*a* via the delivery portion 41*g* (on the right side in FIG. 4). The development chamber 41*a* has an opening at a position corresponding to a development area facing the photosensitive drum 1, and the developing sleeve 44 is rotatably disposed to be partially exposed at an opening portion of the development container 41.

In the first exemplary embodiment, the developing sleeve 44 is made of a nonmagnetic material, and rotates in an arrow direction (counterclockwise) in FIG. 3 during the development operation. The magnet roll 44*a* serving as the magnetic field generating means and having a plurality of magnetic poles in the circumferential direction is fixed inside the developing sleeve 44.

The developer inside the development chamber 41*a* is supplied to the developing sleeve 44 by the screw member 41*d*. A predetermined amount of the developer supplied to the developing sleeve 44 is held on the developing sleeve 44 by an adsorption magnetic pole S1 generated by the magnet roll 44*a* and forms a developer pool. By rotation of the developing sleeve 44, the developing blade 42 regulates the layer thickness of the two-component developer on the developing sleeve 44 by the two-component developer passing the developer pool, and the two-component developer is conveyed to the development area (a position at which the electrostatic latent image formed on the image bearing member is developed) facing the photosensitive drum 1. In the development area, the developer on the developing sleeve 44 is napped at a development magnetic pole S2 and forms a magnetic brush.

Subsequently, the developer on the developing sleeve 44 is conveyed to the inside of the development container 41 while the adsorption of the developer to the surface of the developing sleeve 44 is maintained by a conveyance magnetic pole N2, and then separated from the surface of the developing sleeve 44 by a separation magnetic pole S3. The circumferential speed of the developing sleeve 44 is different from that of the photosensitive drum 1 to sufficiently supply the toner, and the developing sleeve 44 rotates at 680 mm/s (170% of the drum circumferential speed) in the first exemplary embodiment.

In the first exemplary embodiment, as an example of a humidity detector 48 (environment sensor) for detecting humidity (relative humidity) near the development device 4, a humidity sensor for detecting the humidity of the developer contained in the development container 41 is attached to the development container 41, as illustrated in FIG. 2, FIG. 3, and FIG. 4. In the first exemplary embodiment, a temperature-humidity sensor SHT11 manufactured by Sensirion AG is used as the humidity detector 48 to detect the humidity of the developer from the air near the development device 4, so that the humidity of the developer can be directly detected.

In the first exemplary embodiment, the humidity of the developer contained in the development container 41 is directly detected by the humidity detector 48, but the means of detecting the humidity is not limited thereto. Any means may be adopted as long as the humidity of the developer can be detected thereby. For example, instead of being directly detected, the humidity of the developer may be detected by a temperature-humidity sensor attached near the development device 4, or the relative humidity may be predicted based on the absolute humidity of the image forming apparatus 100 and the temperature near the development device 4.

In other words, the present disclosure is similarly applicable to any of a form in which the humidity of the developer contained in the development container is directly detected, a form in which the humidity is detected by the temperature-humidity sensor located near the development device, and a form in which the relative humidity is predicted based on the absolute humidity of the image forming apparatus and the temperature near the development device.

(Configuration of Replenishment Device)

Here, details of the configuration of the replenishment device according to the first exemplary embodiment will be described with reference to the cross-sectional diagram in FIG. 5. A replenishment configuration according to the first exemplary embodiment is based on a configuration in which a replenishment conveyance path 83 extends from a discharge port 82 of the toner cartridge 8 and connects to the toner replenishment port 43 of the development device 4.

First, a replenishment configuration using one replenishment conveyance path 83 will be described as a conventional configuration. In the development device 4, the toner replenishment port 43 is located in the most upstream portion of the stirring chamber 41*b* and outside a developer circulation path. Almost none of the developer in the developer circulation path is present in the developer conveyance member near the toner replenishment port 43, and only the developer for replenishment passes the member. The toner replenishment port 43 connects to a lower end of a tubular member having a square cross-section and serving as the replenishment conveyance path 83. An upper end, which is the other end, of the tubular member connects to the discharge port 82 of the toner cartridge 8.

In the first exemplary embodiment, the toner cartridge 8 has a configuration in which a spiral groove is formed in an inner wall of a cylindrical container, and a conveying force is generated in the longitudinal direction by rotation of the toner cartridge 8, so that a replenishment developer (the replenishment toner) is conveyed to the discharge port 82. The replenishment developer conveyed to the discharge port 82 of the toner cartridge 8 is discharged to the replenishment conveyance path 83 via the discharge port 82, and then arrives at the toner replenishment port 43 of the development device 4 via the replenishment conveyance path 83.

(Toner Scattering)

Figure 6:
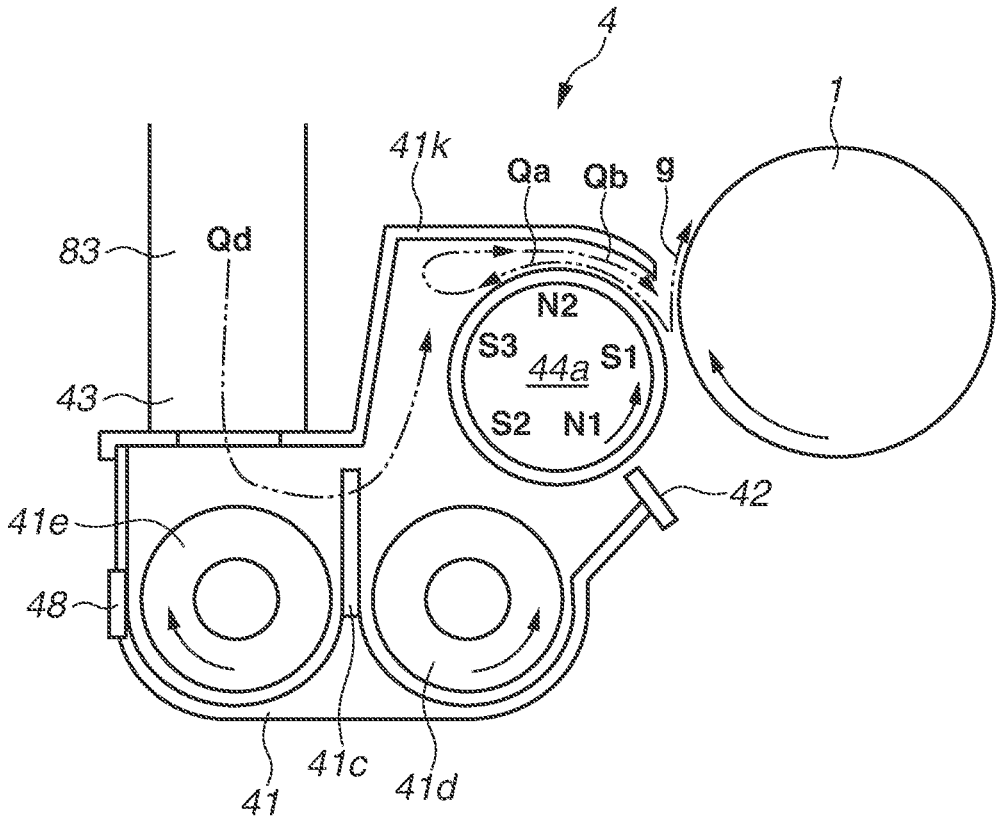
FIG. 6 is a schematic diagram illustrating an air current near the development device according to the first exemplary embodiment.

Toner scattering from a communication port that is formed of a development container top lid 41*k* and the developing sleeve 44 and that connects the inside of the development container 41 and the outside of the development container 41 will be described with reference to FIG. 6. FIG. 6 is a schematic diagram illustrating an air current (airflow) near the development device 4 according to the first exemplary embodiment.

The toner scattering here refers to scattering of toner released inside the development container 41 due to stirring and conveyance of the developer and the toner replenishment, discharged to the outside of the development container 41 via the communication port, and unable to be collected into the development container 41.

First, the toner release will be described. The developer (the two-component developer including the toner and the carrier) contained in the development container 41 is charged by friction in the stirring chamber 41*b* and the development chamber 41*a*, and the toner attaches to the carrier due to an electrostatic attraction force generated by the frictional charge and a non-electrostatic attraction force generated due to surface properties or the like. When a shock or shear force is applied to the toner attaching to the carrier, the toner is separated from the carrier and released in the development container 41.

The shock or shear force at this moment includes developer behavior in the developer conveyance by the developing sleeve 44.

The developer forms a chain-like magnetic brush along a magnetic force line on the magnetic pole of the magnet roll 44*a* inside the developing sleeve 44 as described above. The magnetic brush rises forward immediately before the magnetic pole of the magnet roll 44*a*, and leans forward and falls down upon passing over the magnetic pole. In this process, the rotation direction of the magnetic brush is the same as the rotation direction of the developing sleeve 44. The toner is separated from the carrier by shock and centrifugal force when the magnetic brush falls down, thereby the toner release is caused.

In the developer conveyance by the developing sleeve 44, a factor that greatly contributes to the toner release is a factor by the separation magnetic pole S3 that generates a repulsion magnetic field. At the separation magnetic pole S3, to separate the developer from the developing sleeve 44, a magnetic force is applied in the direction opposite to the developing sleeve 44 by this magnetic pole, thereby the speed of the developer is decreased so that the developer stays. At this moment, the length of the magnetic brush increases, and thus the shock and the centrifugal force when the magnetic brush falls down also increases, so that the amount of the released toner tends to increase. The shock when the magnetic brush falls down also occurs at the development magnetic pole S2 and the conveyance magnetic pole N2, and therefore, the toner release also occurs at the development magnetic pole S2 and the conveyance magnetic pole N2, although the amount of the released toner is less than that at the separation magnetic pole S3.

The toner whirled up before being sufficiently stirred when the toner is supplied via the toner replenishment port 43 by the replenishment device is also a factor of the released toner inside the development container 41. As described above, the replenishment toner supplied to the toner replenishment port 43 is stirred and conveyed with the developer already present in the stirring chamber 41*b*. In this process, in an area where the replenishment toner and the developer are mixed, a toner to developer mixture ratio (T/D ratio) is temporarily high. In a case where the T/D ratio is high, a charge amount of the toner decreases, so that the electrostatic attraction force between the toner and the carrier decreases. The replenishment toner failed to mix with the developer is released as it is by shock in stirring and conveying the developer by the screw members 41*d* and 41*e*, and the released toner whirls up inside the development container 41.

Next, the air current (airflow) near the development device 4 will be described with reference to FIG. 6.

The developing sleeve 44 and the photosensitive drum 1 generate the air current near the development device 4. As illustrated in FIG. 6, the air current is generated in the same direction as the rotation direction of the developing sleeve 44 by the rotation of the developing sleeve 44 and the behavior of the magnetic brush on the magnetic pole of the magnet roll 44*a*. The air current generated in the same direction as the rotation direction of the developing sleeve 44 contributes to taking the air from the communication port connecting the inside of the development container 41 and the outside of the development container 41 into the development container 41. The air also flows into the development container 41 by the toner replenishment by the replenishment device.

In a case where the development device 4 in the longitudinal cross-section is assumed to be a substantially enclosed space, since the air is a fluid, the following equation is applicable. There is no gush of air in the development chamber, and thus the equation can be expressed as follows, where the flow velocity of the air is v, and the density is ρ.

$$\partial\rho/\partial t+\nabla\rho v=0 \quad (1)$$

Further, in a steady state, the density ρis substantially constant in each area inside the development container 41. Therefore, the equation (1) can be expressed as follows.

$$\rho\nabla v=0 \quad (2)$$

A flow amount ρv of air is saved based on this equation. In the longitudinal cross-section near the development device 4, the balance of the flow amount ρv is 0, and the same amount of air as the amount of air flowing in due to the developing sleeve 44 and the replenishment described above is discharged to the outside of the development device 4.

Further, as the developing sleeve 44 rotates, the air flows into the development container 41 via a communication port formed of the development container top lid 41*k* and the developing sleeve 44. At this moment, the amount of air flowing into the development container 41 is an airflow amount Qa (developing sleeve inflow).

In addition, the air discharged from the communication port connecting the inside of the development container 41 and the outside of the development container 41 is discharged from a part on the development container top lid 41*k* side, in the direction opposite to a direction of the air taken in from the communication port. At this moment, the amount of the air discharged from the part on the development container top lid 41*k* side is an airflow amount Qb (developing sleeve discharge). The amount of air that flows in accompanying the supply to the development device 4 is an airflow amount Qd (replenishment inflow).

In this case, among the three airflow amounts, i.e., the airflow amount Qa (developing sleeve inflow), the airflow amount Qb (developing sleeve discharge), and the airflow amount Qd (replenishment inflow), the following relationship is established.

$$\text{Qa (developing sleeve inflow)}+\text{Qd (replenishment inflow)}=\text{Qb (developing sleeve discharge)} \quad (3)$$

For the air taken in by the developing sleeve 44 and flowing along the developing sleeve 44 to be discharged, the air is to double back inside the development device 4. Usually, the air taken in by the developing sleeve 44 and flowing along the developing sleeve 44 leaves the developing sleeve 44 in a developer staying portion of the separation magnetic pole S3, and subsequently doubles back. At this moment, the air current after doubling back contains the toner released inside the development container 41 and moves in the discharging direction.

Mainly, the following two factors cause the discharge of the released toner contained in the airflow amount Qb (developing sleeve discharge) to the outside of the development container 41. First, the airflow amount Qb (developing sleeve discharge) discharged to the outside of the development device 4 via the communication port connecting the inside of the development container 41 and the outside of the development container 41 is directly discharged from a gap between the development container top lid 41*k* and the photosensitive drum 1. Second, the airflow amount Qb (developing sleeve discharge) is mixed near the photosensitive drum 1 with, or the released toner transfers to, an air current g generated by the photosensitive drum 1 due to an inertial force, so that the airflow amount Qb is discharged by riding on the air current g generated by the photosensitive drum 1.

The scattering toner is discharged to the outside of the development container 41 by at least one of the above-described two factors. The toner scattered to the outside of the development container 41 can contaminate an area around the development device 4, an external wall of the development container 41, the photosensitive drum 1, the exposure device 3, and the transfer device 5. The phenomenon in which the toner scatters riding on the air current (airflow) near the development device 4 is more noticeable as the process speed increases due to the speed enhancement of the image forming apparatus 100. This is because, as the process speed increases due to the speed enhancement of the image forming apparatus 100 and the circumferential speed of the developing sleeve 44 increases accordingly, the air flowing into the development container 41 by the rotation of the developing sleeve 44 increases.

As described above, the toner scattering is caused by the toner released when the charge amount of the toner decreases. The charge amount of the toner of the developer inside the development container 41 tends to decrease as the time elapsed from the stoppage of driving of the screw members 41*d* and 41*e* of the development device 4 and the developing sleeve 44 increases.

Suppose the time elapsed from the previous stoppage of driving of the screw members 41*d* and 41*e* of the development device 4 and the developing sleeve 44 is a predetermined time or longer when the image forming apparatus 100 is powered on (when shifted from power-off to power-on). In this case, the image forming apparatus 100 increases the charge amount of the toner of the developer inside the development container 41 by executing a mode (idle rotation mode) for driving each of the screw members 41*d* and 41*e* and the developing sleeve 44 by using the driving means without performing image formation for a predetermined time. After the idle rotation mode is executed for the predetermined time, the image forming process (image forming operation) begins.

However, in a case where the relative humidity near the development device 4 when the image forming apparatus 100 is powered on is higher than a predetermined value, a decline in the charge amount of the toner inside the development container 41 can be noticeable compared with a case where the relative humidity is lower than or equal to the predetermined value. In the case where the decline in the charge amount of the toner is noticeable, even if the screw members 41*d* and 41*e* and the developing sleeve 44 are each driven at a speed lower than a normal speed in the idle rotation mode, the toner can scatter accompanying driving of the developing sleeve 44.

Meanwhile, in the case where the relative humidity near the development device at power-on is higher than the predetermined value, the temperature inside the image forming apparatus is increased by temperature adjustment or the like of the fixing device after power-on, so that the relative humidity near the development device decreases and eventually falls below the predetermined value.

Meanwhile, in the case where the relative humidity near the development device 4 when the image forming apparatus 100 is powered on is higher than the predetermined value, the temperature inside the image forming apparatus 100 is increased by temperature adjustment or the like of the fixing device 6 after power-on, so that the relative humidity near the development device 4 decreases. There is such a relationship that, in a case where the relative humidity near the development device 4 is low, the charge amount of the toner inside the development container 41 increases compared with a case where the relative humidity near the development device 4 is high.

For this reason, the degree of toner scattering in the idle rotation mode can be reduced by executing the idle rotation mode after the relative humidity near the development device 4 after power-on falls below the predetermined value in the case where the relative humidity near the development device 4 at power-on is higher than the predetermined value.

Therefore, in the first exemplary embodiment, in the case where the relative humidity near the development device 4 when the image forming apparatus 100 is powered on is higher than the predetermined value, the idle rotation mode is executed after the relative humidity near the development device 4 after power-on falls below the predetermined value. The degree of toner scattering in the idle rotation mode is thereby reduced. The details thereof will be described below.

Figure 7:
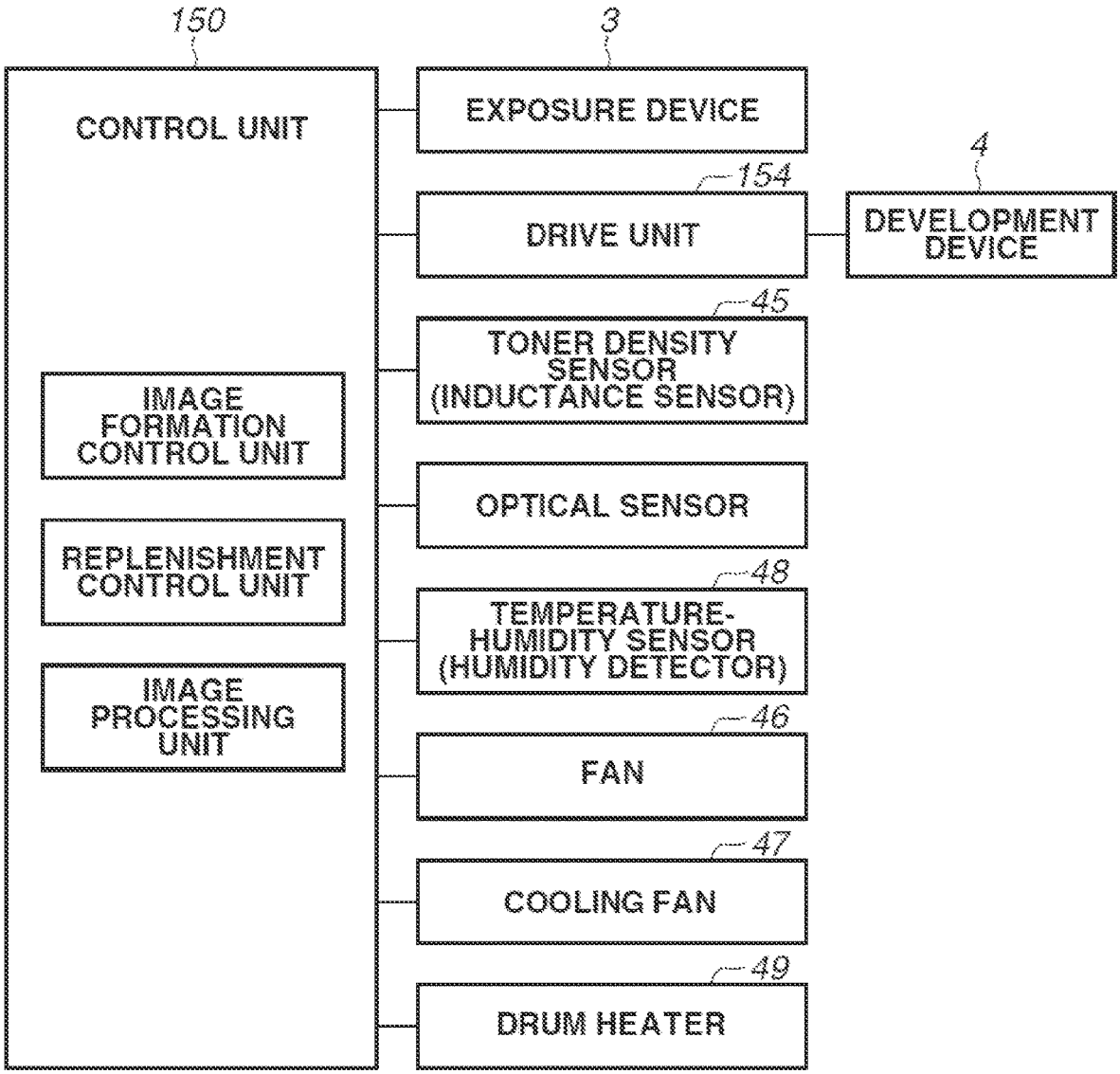
FIG. 7 is a block diagram illustrating the image forming apparatus according to the first exemplary embodiment.
Figure 8:
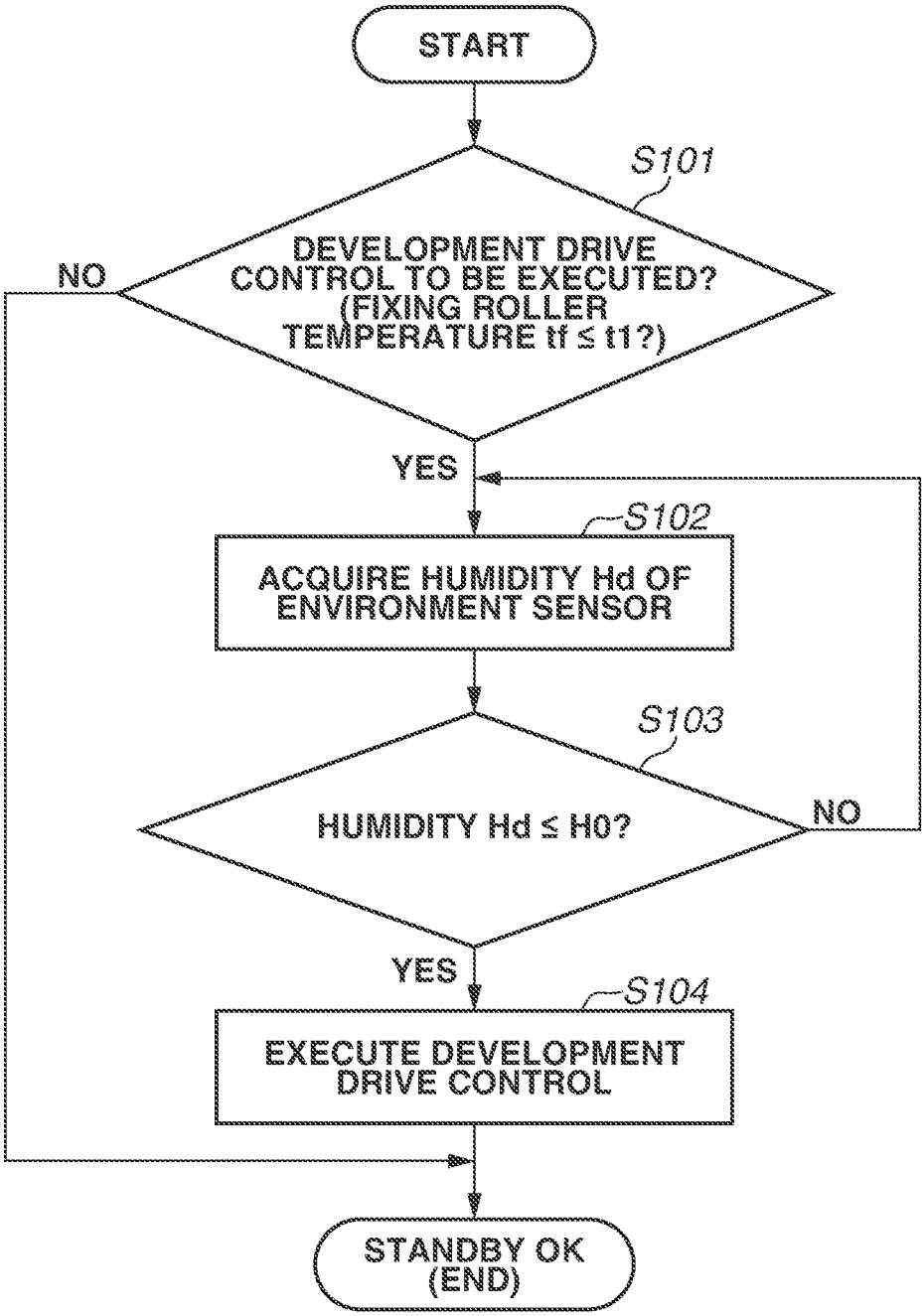
FIG. 8 is a flowchart illustrating a control example according to the first exemplary embodiment.

FIG. 7 illustrates a block diagram of the image forming apparatus 100 according to the first exemplary embodiment. FIG. 8 is a flowchart illustrating a control example according to the first exemplary embodiment. First, when the image forming apparatus 100 is returned from any of the state where the last image forming process is stopped, the power-off state, and the sleep state, whether to execute image stabilization control is determined (determined based on the temperature of the fixing roller of the fixing device 6 in the first exemplary embodiment).

In the following description, there will be described an example in which, using the power-on of the image forming apparatus 100 as a trigger, the control in FIG. 8 is executed in consideration of the relative humidity near the development device 4 at the power-on of the image forming apparatus 100, but the trigger is not limited to this example. There may be adopted a modification in which, using the return of the image forming apparatus 100 from the sleep state as a trigger, the control in FIG. 8 is executed in consideration of the relative humidity near the development device 4 at the time of the return of the image forming apparatus 100 from the sleep state. Further, there may be adopted a modification in which, using the elapse of a predetermined time or longer from the previous stoppage of driving of the screw members 41*d* and 41*e* and the developing sleeve 44 as a trigger, the control in FIG. 8 is executed in consideration of the relative humidity near the development device 4 at the time when the predetermined time or longer has elapsed.

A control unit 150 reads a control program stored in a read only memory (ROM) and controls various devices based on the control program, thereby executing the control in FIG. 8. The procedure of the control in FIG. 8 begins upon the power-on of the image forming apparatus 100 (i.e., upon shifting of the power of the image forming apparatus 100 from off to on).

The control unit 150 starts the processing from step S101 using shifting of the power of the image forming apparatus 100 from off to on as a trigger. The temperature of the fixing roller of the fixing device 6 is tf, and the relative humidity near the development device 4 is Hd. In step S101, the control unit 150 determines whether the fixing roller temperature tf of the fixing device 6 is lower than or equal to a predetermined value t1, i.e., tf≤t1. If the fixing roller temperature tf of the fixing device 6 is lower than or equal to the predetermined value t1, i.e., tf≤t1 (YES in step S101), the processing proceeds to step S102. On the other hand, if the fixing roller temperature tf of the fixing device 6 is higher than the predetermined value t1, i.e., tf>t1 (NO in step S101), the image forming apparatus 100 enters a standby OK state, i.e., a state where the image forming process (image forming operation) can start, and the series of steps of processing in FIG. 8 ends.

In step S102, the control unit 150 acquires humidity Hd (relative humidity) near the development device 4 based on a detection result of the humidity detector 48 serving as the environment sensor. Subsequently, in step S103, the control unit 150 determines whether the humidity Hd near the development device 4 is lower than or equal to a predetermined value H0. If the humidity Hd near the development device 4 is higher than the predetermined value H0 (NO in step S103), the processing returns to step S102. On the other hand, if the humidity Hd near the development device 4 is lower than or equal to the predetermined value H0 (YES in step S103), the processing proceeds to step S104.

In step S104, the control unit 150 executes the idle rotation mode (development drive control) in the image stabilization control. In the idle rotation mode, the control unit 150 controls a drive unit 154 (the driving means) to rotate each of the screw members 41*d* and 41*e* and the developing sleeve 44 without executing the image forming process (image forming operation). Executing the idle rotation mode (development drive control) increases the charge amount of the toner inside the development container 41, thereby bringing the image forming apparatus 100 into the standby OK state, i.e., the state where the image forming process (image forming operation) can start, and therefore, the series of steps of processing in FIG. 8 ends.

Conventionally, in a case where the fixing roller temperature tf of the fixing device 6 is lower than or equal to the predetermined value t1, i.e., tf≤t1, the idle rotation mode (also referred to as the development drive control) is immediately executed in the image stabilization control regardless of the relative humidity Hd near the development device 4. In other words, conventionally, in the case where the fixing roller temperature tf of the fixing device 6 is lower than or equal to the predetermined value t1, i.e., tf≤t1, the idle rotation mode is executed in the image stabilization control even if the relative humidity Hd near the development device 4 is higher than the predetermined value H0.

However, in the first exemplary embodiment, even if the fixing roller temperature tf of the fixing device 6 is lower than or equal to the predetermined value t1, i.e., tf≤t1, the idle rotation mode is not executed immediately in the case where the relative humidity Hd near the development device 4 is higher than the predetermined value H0. Meanwhile, the temperature inside the image forming apparatus 100 is increased by the temperature adjustment or the like of the fixing device 6 after power-on, so that the relative humidity near the development device 4 after power-on decreases, and, as a result, the relative humidity near the development device 4 falls below the predetermined value H0, and the idle rotation mode is executed upon this fall.

In other words, in the first exemplary embodiment, even if the humidity Hd near the development device 4 is higher than the predetermined value H0 (NO in step S103), the temperature inside the image forming apparatus 100 increases before long, and the relative humidity near the development device 4 decreases. The condition that the relative humidity near the development device 4 after the power-on of the image forming apparatus 100 is lower than or equal to the predetermined value is thereby satisfied. In this way, the idle rotation mode is executed after the condition that the relative humidity near the development device 4 after the power-on of the image forming apparatus 100 is lower than or equal to the predetermined value is satisfied.

This suppresses the degree of decline in the charge amount of the toner inside the development container 41 at the time when the image forming apparatus 100 is returned from any of the state where the image forming process is stopped, the power-off state, and the sleep state and before the idle rotation mode is executed, and therefore, the degree of toner scattering in the idle rotation mode can be reduced.

An outline of a method of measuring a toner scattering amount adopted in a verification experiment for the present exemplary embodiment will be described. In an area except for both ends of the development device 4 in the longitudinal direction, the scattering toner scatters to the outside of the development device 4 by passing through a flow path between an area facing the photosensitive drum 1 of the development container top lid 41*k* and the photosensitive drum 1.

Thus, a substantially central part of the flow path is irradiated with a laser beam emitted by a line laser, so that the laser beam is perpendicular to the developing sleeve 44 and the photosensitive drum 1. The line laser is a laser that emits a linear laser beam having a certain line width and forming a fan-shaped two-dimensional plane optical path. Typically, a laser beam emitted from a dot laser is dispersed in certain directions using a cylindrical lens or a rod lens, so that the optical path is formed. The scattering toner flying on the optical path of the line laser scatters the laser beam. Thus, it is possible to measure the number of pieces and the trace of the scattered toner present in a range irradiated with the laser beam by observing the scattered toner using a high-speed camera or the like from a direction substantially perpendicular to the irradiation direction of the line laser beam.

A high-power laser (class 3R or higher) is used in the above-described measurement, and thus it is desirable to perform an experiment in an environment with safety facilities (such as a warning label, laser shield facilities, and an interlock) based on the guidelines of the Ministry of Health, Labour and Welfare. Thus, an experimental device is created by extracting the development device 4 and the photosensitive drum 1 that contribute to the toner scattering to a great extent as described above, as well as the positional relationship, driving, and control of these components, and the experiment is performed using the safety facilities.

As for the line laser, a YAG laser manufactured by Japan Laser Corporation is used as a light source, and an optical system using a cylindrical lens is adjusted so that a line laser beam having a line width of 0.5 mm on the flow path is emitted. As for the observation, a high-speed camera SA-3 manufactured by Photron Limited is used, and image-capturing conditions (a frame rate and an exposure time) of the high-speed camera and an optical system (such as a lens) are selected so that the scattering toner in the line laser beam can be observed.

Figure 9A:
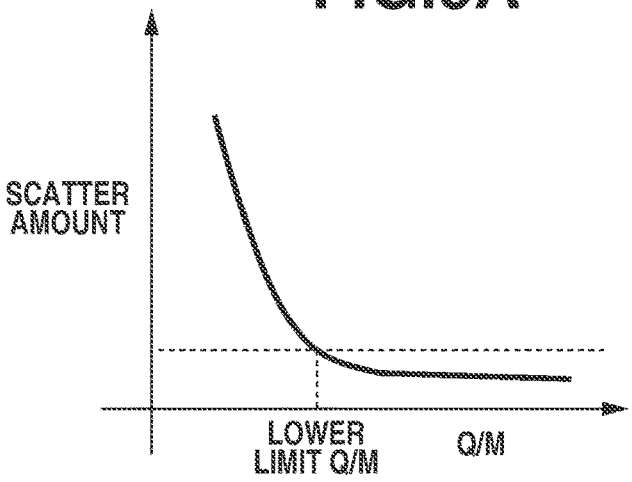
FIGS. 9A, 9B, and 9C are graphs illustrating experimental results according to the first exemplary embodiment.

FIG. 9A illustrates a graph representing a charge amount Q/M [μC/g] per unit mass of the developer and a scatter amount [piece/0.5 sec] measured at that time, as an experimental result according to the first exemplary embodiment. As illustrated in the graph in FIG. 9A, the smaller the charge amount Q/M of the toner is, the larger the toner scatter amount is. As illustrated in FIG. 9A, the tendency is not linear, and the toner scatter amount rapidly increases when the charge amount Q/M falls below a certain amount. This occurs because a driving force causing the toner scattering is greater than an electrostatic attraction force attributed to the charge amount of the toner.

Therefore, there is a lower limit of the charge amount Q/M, falling below which is not acceptable, when any of the state where the image forming process (image forming operation) is stopped, the power-off state, and the sleep state continues for a long time in a high humidity environment.

Figure 9B:
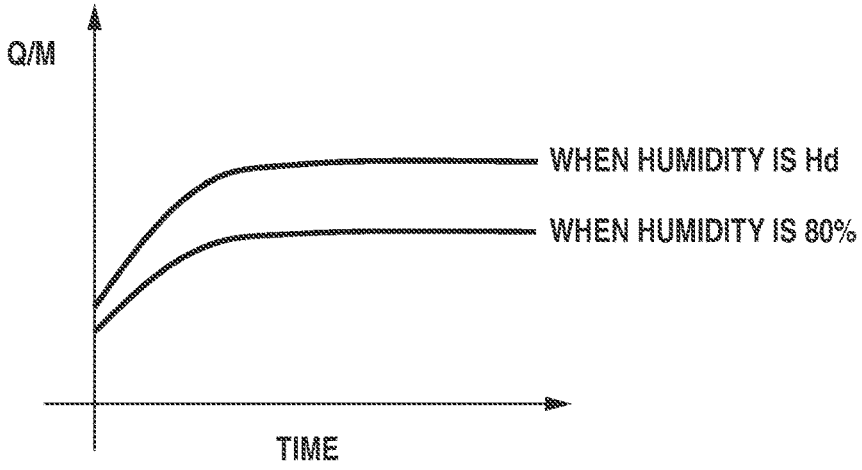
Figure 9C:
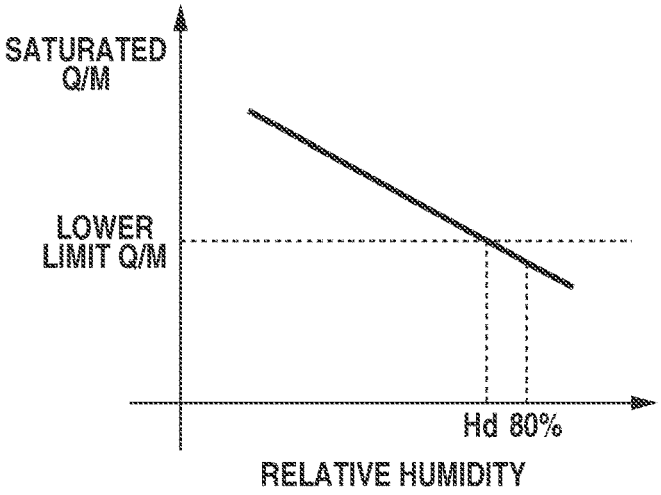

FIG. 9B illustrates a graph in which rises of the charge amount Q/M with respect to the development drive time from a state where driving is not performed for a long time, such as any of the state where the image forming process is stopped, the power-off state, and the sleep state. As illustrated in FIG. 9B, a saturated Q/M value when the humidity is 80% and a saturated Q/M value when the humidity is Hd are different. The relationship between the relative humidity and the saturated Q/M is illustrated as in FIG. 9C, thus a value of the relative humidity Hd for changing the charge amount Q/M to a value equal to or higher than the lower limit, falling below which is not acceptable, is estimated. Therefore, if the relative humidity is equal to or higher than Hd that is a threshold for starting the development drive (driving of each of the screw members 41*d* and 41*e* and the developing sleeve 44 by the driving means), the toner scattering can be reduced even if the development drive starts in the image stabilization control.

In the first exemplary embodiment, whether to execute the image stabilization control is determined at the time of returning from any of the state where the image forming process (image forming operation) is stopped, the power-off state, and the sleep state. In a case where the relative humidity Hd near the development device 4 satisfies the condition that the relative humidity Hd is lower than or equal to the predetermined value H0 as a result of the determination, the idle rotation mode is executed, so that the toner scattering in the idle rotation mode is reduced. However, there can be a case where the humidity does not fall below the predetermined value even after the lapse of a certain period of time, or it takes a long time for the humidity to fall below the predetermined value, depending on the environment where the image forming apparatus 100 is installed.

Therefore, in a second exemplary embodiment, there will be described a configuration in which the relative humidity Hd near the development device 4 is decreased to fall below the predetermined value H0 by a humidity decreasing means of the image forming apparatus 100. In the second exemplary embodiment, only a point different from the first exemplary embodiment will be described. Configurations and functions in other points are similar to those of the first exemplary embodiment and thus the details thereof will be omitted.

Figure 10A:
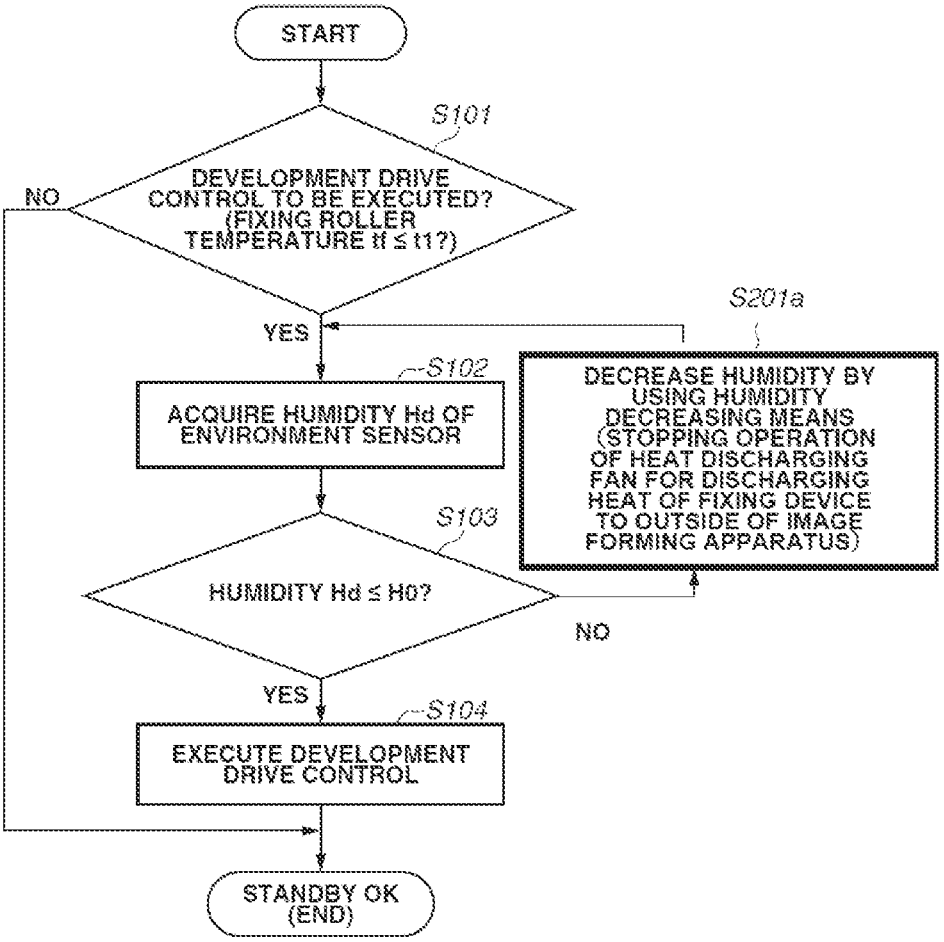
FIGS. 10A, 10B, and 10C are flowcharts illustrating a control example according to a second exemplary embodiment.
Figure 10B:
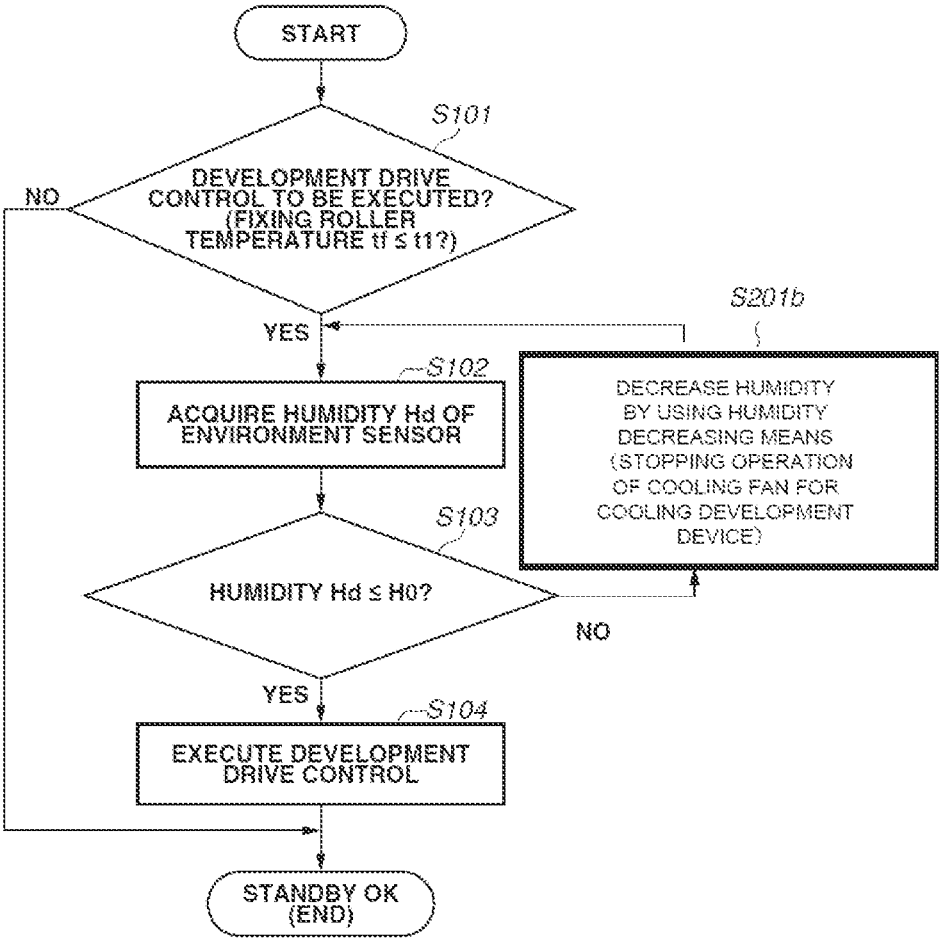
Figure 10C:
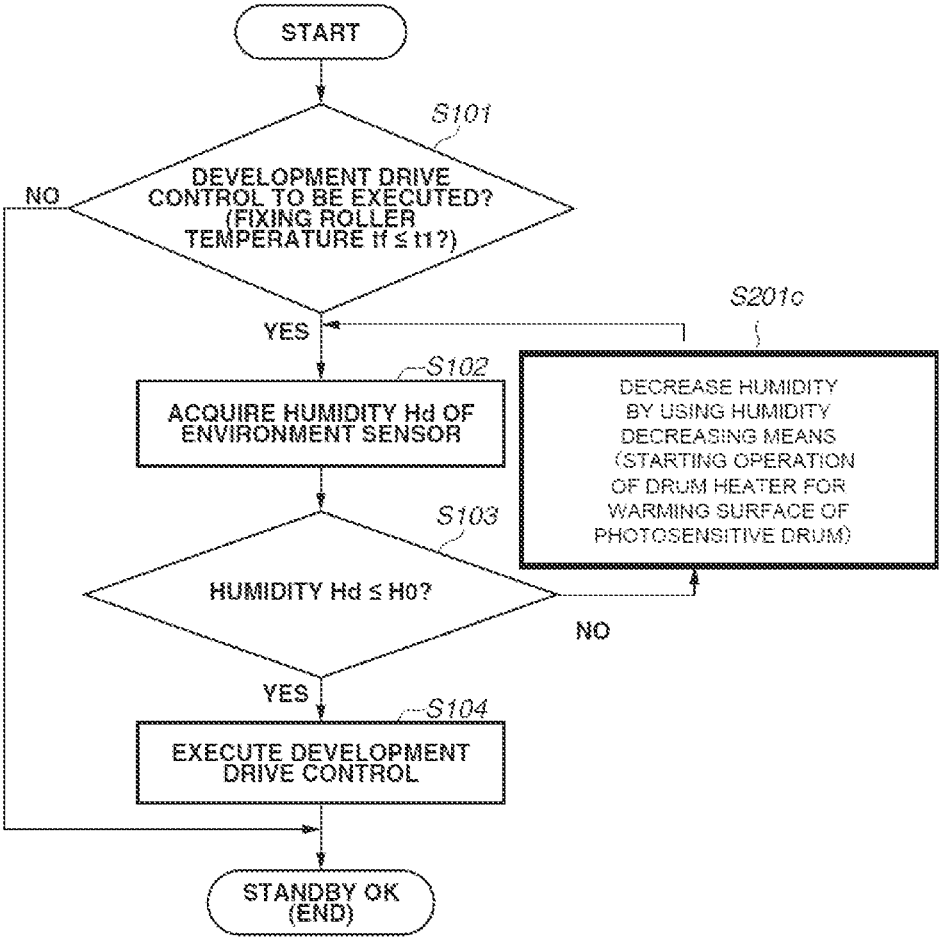

The control unit 150 reads a control program stored in the ROM and controls various devices based on the control program, thereby executing control in FIG. 10A, 10B, or 10C. The procedure of the control in FIG. 10A, 10B, or 10C begins upon the power-on of the image forming apparatus 100 (i.e., upon shifting of the power of the image forming apparatus 100 from off to on).

In the following description, there will be described an example in which, using the power-on of the image forming apparatus 100 as a trigger, the control in FIG. 10A, 10B, or 10C is executed in consideration of the relative humidity near the development device 4 at the power-on of the image forming apparatus 100, but the trigger is not limited to this example. There may be adopted a modification in which, using the return of the image forming apparatus 100 from the sleep state as a trigger, the control in FIG. 10A, 10B, or 10C is executed in consideration of the relative humidity near the development device 4 at the time of the return of the image forming apparatus 100 from the sleep state. Further, there may be adopted a modification in which, using the elapse of a predetermined time or longer from the previous stoppage of driving of the screw members 41*d* and 41*e* and the developing sleeve 44 as a trigger, the control in FIG. 10A, 10B, or 10C is executed in consideration of the relative humidity near the development device 4 at the time when the predetermined time or longer has elapsed.

In step S102, the control unit 150 acquires the humidity Hd (relative humidity) near the development device 4, based on a detection result of the humidity detector 48 serving as the environment sensor. If the humidity Hd near the development device 4 is higher than the predetermined value H0 (NO in step S103), the processing proceeds to step S201*a* as illustrated in FIG. 10A (or step S201*b* as illustrated in FIG.

10B or step S201*c* as illustrated in FIG. 10C). In step S201*a* as illustrated in FIG. 10A (or step S201*b* as illustrated in FIG. 10B or step S201*c* as illustrated in FIG. 10C), the control unit 150 controls the humidity decreasing means to continue control for decreasing the humidity Hd near the development device 4 until the humidity Hd near the development device 4 falls below the predetermined value H0 (step S103 (NO)→step S201*a* as illustrated in FIG. 10A (or step S201*b* as illustrated in FIG. 10B or step S201 *c* as illustrated in FIG. 10C)→step S102→step S103).

The humidity decreasing means described here is not limited to a specific means for reducing humidity, and may be any means as long as the means affects the humidity inside the image forming apparatus 100, the humidity near the development device 4, and the humidity of the developer contained in the development container 41. Examples of the humidity decreasing means include stopping the operation of a heat discharging fan 46 for discharging heat of the fixing device 6 to the outside of the image forming apparatus 100 as illustrated in FIG. 10A (in step S201*a*), stopping the operation of a cooling fan 47 for cooling the development device 4 as illustrated in FIG. 10B (in step S201*b*), and starting the operation of a drum heater 49 for warming the surface of the photosensitive drum 1 as illustrated in FIG. 10C (in step S201*c*). Further, these examples of the humidity decreasing means may be combined as appropriate.

Therefore, the temperature inside the apparatus is increased by the temperature adjustment for fixing after power-on, and in addition, the humidity near the development device 4 is decreased by the humidity decreasing means in a case where the humidity Hd near the development device 4 is higher than the predetermined value H0. Further, the idle rotation mode is executed after the humidity Hd near the development device 4 satisfies the condition that the humidity Hd is lower than or equal to the predetermined value H0. This suppresses the degree of decline in the charge amount of the toner inside the development container 41 at the time when the image forming apparatus 100 is returned from any of the state where the image forming process is stopped, the power-off state, and the sleep state and before the idle rotation mode is executed, and therefore, the degree of toner scattering in the idle rotation mode can be reduced.

In addition, in the second exemplary embodiment, because the humidity near the development device 4 is decreased by the humidity decreasing means, it is possible to reduce the time taken before the humidity Hd near the development device 4 reaches the predetermined value H0. Therefore, the second exemplary embodiment is more advantageous than the first exemplary embodiment in that it is possible to reduce downtime at the time when the image forming apparatus 100 is returned from any of the state where the image forming process is stopped, the power-off state, and the sleep state and before the execution of the idle rotation mode begins.

The present disclosure is not limited to the above-described exemplary embodiments. Various modifications (including organic combinations of the exemplary embodiments) can be made based on the gist of the present disclosure, and those are not excluded from the scope of the present disclosure.

In the above-describe exemplary embodiments, the image forming apparatus configured to use the intermediate transfer belt 51 as illustrated in FIG. 1 is described as an example, but the present disclosure is not limited to this example. The present disclosure is also applicable to an image forming apparatus configured to perform transfer by bringing a recording medium into direct contact with photosensitive drums sequentially.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-024133, filed Feb. 18, 2021, which is hereby incorporated by reference herein in its entirety.

What is claimed is:

1. An image forming apparatus to execute an image forming operation for forming an image, the image forming apparatus comprising:

an image bearing member;

a development unit including a development container configured to contain a developer including toner and carrier, a conveyance member configured to convey the developer contained in the development container, and a developer carrying member configured to carry the developer to convey the developer to a position at which an electrostatic latent image formed on the image bearing member is developed;

a humidity detection unit configured to detect humidity near the development unit;

a drive unit configured to drive each of the conveyance member and the developer carrying member; and a controller configured to control the drive unit to execute a mode for driving each of the conveyance member and the developer carrying member without executing the image forming operation, wherein the controller:

(i) controls the drive unit to execute the mode in a case where the humidity detected by the humidity detection unit when power of the image forming apparatus is shifted from off to on is less than or equal to a predetermined value, and (ii) controls the drive unit, in a case where the humidity detected by the humidity detection unit when the power of the image forming apparatus is shifted from off to on is higher than the predetermined value, to wait until the humidity detected by the humidity detection unit becomes less than or equal to the predetermined value without executing the mode, and then, when the humidity detected by the humidity detection unit becomes less than or equal to the predetermined value, to execute the mode.

2. The image forming apparatus according to claim 1, further comprising:

a transfer unit configured to transfer the image formed by the image forming operation to a recording medium;

a fixing unit configured to heat the image transferred to the recording medium by the transfer unit to fix the image to the recording medium; and a fan configured to discharge heat generated by the fixing unit to outside of the image forming apparatus, wherein the controller controls the drive unit to stop operation of the fan without executing the mode in the case where the humidity detected by the humidity detection unit when the power of the image forming apparatus is shifted from off to on is higher than the predetermined value, and afterward to execute the mode in the case where the humidity detected by the humidity detection unit falls below the predetermined value.

3. The image forming apparatus according to claim 1, further comprising a cooling fan configured to cool the development unit, wherein the controller controls the drive unit to stop operation of the cooling fan without executing the mode in the case where the humidity detected by the humidity detection unit when the power of the image forming apparatus is shifted from off to on is higher than the predetermined value, and afterward to execute the mode in the case where the humidity detected by the humidity detection unit falls below the predetermined value.

4. The image forming apparatus according to claim 1, further comprising a heater configured to warm a surface of the image bearing member, wherein the controller controls the drive unit to turn on the heater without executing the mode in the case where the humidity detected by the humidity detection unit when the power of the image forming apparatus is shifted from off to on is higher than the predetermined value, and afterward to execute the mode in the case where the humidity detected by the humidity detection unit falls below the predetermined value.

5. The image forming apparatus according to claim 1, wherein the humidity detection unit is in the development unit.

6. The image forming apparatus according to claim 1, wherein the humidity detection unit detects humidity of the developer contained in the development container as the humidity near the development unit.

* * * * *